US005477999A

United States Patent [19]

Blankenship, Jr.

[11] Patent Number: 5,477,999

[45] Date of Patent: Dec. 26, 1995

[54] SPRAY CONTAINER CARRIAGE AND RETRIEVAL SYSTEM

[76] Inventor: William F. Blankenship, Jr., 2165 E. Colton Ave., Mentone, Calif. 92359

[21] Appl. No.: 343,378

[22] Filed: Nov. 22, 1994

Related U.S. Application Data

[62] Division of Ser. No. 151,495, Nov. 12, 1993, Pat. No. 5,392,975.

[51] Int. Cl.[6] ..... A45C 11/32

[52] U.S. Cl. ..... 224/253; 224/242; 224/228; 224/246; 224/914; 224/196; 224/148; 206/317; 221/185

[58] Field of Search ..... 224/253, 242, 224/228, 245, 246, 250, 251, 914, 196, 148, 236, 240, 252, 231, 223, 203; 221/185; 222/175, 182, 183; 206/317; 102/430

[56] References Cited

U.S. PATENT DOCUMENTS

| | | | |
|---|---|---|---|
| 3,445,046 | 5/1969 | Wilson | 224/26 |
| 5,174,482 | 12/1992 | Rogers et al. | 224/239 |
| 5,305,874 | 4/1994 | McLaughlin | 206/37 |
| 5,392,975 | 2/1995 | Blankenship, Jr. | 224/253 |

*Primary Examiner*—Henry J. Recla
*Assistant Examiner*—Steven O. Douglas
*Attorney, Agent, or Firm*—Curtis L. Harrington

[57] ABSTRACT

A spray container storage and retrieval system encompassing both an apparatus and method enabling quick, safe retrieval of a spray container from a holster.

In a first embodiment, a spray container with a forward trigger is stored in a specially designed sleeve having a special surface for securing the forward trigger from the discharge position. In a second embodiment, a flanged sleeve facilitates the springing displacement of a spray container having a safety flap over the discharge button and is intended to be used with a flap holster, and with a spray container which has no discharge button which can be utilized with a specialized structure on the sleeve. The third embodiment includes an open holster having an inwardly disposed locking groove which engages a pin collar fitted about the upper portion of a spray container, which can be re-used on subsequent spray containers by removing it from the used spray container and re-installing it on the new spray container. This third embodiment is released by pushing down and rotating slightly on the upper portion of the spray container to cause its pin collar to unlock from the inwardly disposed locking groove, and to be springingly released upwardly.

7 Claims, 5 Drawing Sheets

SPRAY CONTAINER CARRIAGE AND RETRIEVAL SYSTEM

This is a divisional of application Ser. No. 08/151,495, now U.S. Pat No. 5,392,975, filed on Nov. 12, 1993.

FIELD OF THE INVENTION

The present invention relates to the field of accessories for carrying self defense sprays, such as pepper spray or mace. More specifically, the present invention relates to a system and method for safe carriage of the spray container, but where very quick removal of the spray container from the carriage structures is effected.

BACKGROUND OF THE INVENTION

Spray containers which are used to deliver a stream of liquid or liquid spray for the purpose of demobilizing an attacker are becoming more popular. Not only are these so-called pepper sprays used for personal defense, but police agencies are using them as a more humane substitute for lethal force in instances where a suspect is irrational and unresponsive to orders.

Sprays utilized by citizens for their personal use often come equipped with a locking cap to prevent the spray from being actuated until the locking cap is removed or turned to enable the spray to be used. Some sprays come equipped with their own carrier to cover and prevent from unintended use the spray container. Schemes for preventing inadvertent discharge of the spray container are definitely necessary since an unwanted discharge can cause clothing, purses, and other storage areas to be ruined. The problem with many of the mechanisms for preventing unwanted discharge is that such mechanisms severely hinder the ability to produce the spray container quickly from its storage position.

In fact, some of the very schemes which were originally designed to prevent unwanted discharge can actually contribute to the unwanted discharge when the canister is to be retrieved in an emergency situation. Some spray containers are equipped with a forward trigger which predominantly extends forward of the canister. When carried in a holster, the forward trigger presents itself as one of two opposing surfaces which may be grasped in order to bring the spray container from the holster. Typically the user, in an emergency situation, will grasp the forward trigger and rear section of the head and lift. The result will typically cause the spray container to discharge onto the user's hands and clothing. If the discharge is sufficient to partially disable or immobilize the user, the purpose of carrying the spray will not only be frustrated, but also work out to a net detriment to the user.

Other schemes have utilized a configuration where the spray container is spring urged from its bottom from a simple tube. In this configuration, the spray container can be discharged inadvertently while in its holster. Further, where the rim of a holster structure is utilized as a safety to hold a trigger from its discharge position, such safety can fail where the trigger is depressed for several reasons. First, the slope and thickness of the rim may not be sufficient to hold the trigger mechanism away from discharge. Second, if the spray container is allowed to be displaced upwardly only a small amount, the use of a rim to inhibit discharge will be defeated.

With other spray containers, particularly those having a deep vertical displacement and discharge button safety cover, the use of a flap type holster arrangement will not enable the spray container to be produced as quickly as is necessary. Further, because the tops of such canisters are rounded, much like the top of a shaving cream can, the ability to retrieve it from a full deep holster is inhibited. With a conventional full deep holster, the user must open the flap, and attempt to grasp the region of a spray container which has very little lateral area at its upper portion.

The use of spray containers without a covering flap is desired, but like any such uncovered equipment, especially for police use, a suspect could quickly grasp the spray container and use it on the officer. This scenario is much more likely to cause the suspect and others to be shot, particularly if the officer becomes so impaired and immobilized that resort must be had to the service revolver.

Another serious shortcoming of previously available holsters relates to the use of closed bottom holsters. If a spray container is enabled to be ejected quickly from a holster, there should be a provision for air to enter the bottom of the holster to quickly displace the volume of the spray container as it is lifted upwardly. A closed bottom holster can severely inhibit this flow of displacement air. The alternative of making the spray container smaller than the portion of the holster it comes into contact with is unacceptable for two reasons.

First, it would cause the holster to be much larger than the spray container. The space for, weight and size of equipment to be carried by officers must be conserved, not only to insure that the officers can have sufficient space to carry the other equipment which is needed, but for a given level of equipment to reduce the bulkiness of the equipment area so that the officer is physically more free to move about. Secondly, a spray container significantly smaller than its holster would cause the canister to rattle about in an annoying fashion. If the canister were so small that it could form a significant angle with respect to the portion of the holster with which it was in contact, the canister could Jam against such surface.

Another major problem with spray containers is the depth of the spray container as a match requirement against the depth of a closed holster. A spray container within a holster which is too deep can virtually never be quickly retrieved. The user must either insert the fingers into the holster and "fish" for the canister, or twist the holster to an inverted position to cause the spray container to fall out. This manner of operation is unacceptable.

In the case of spring urged sleeves, in instances where the sleeve is shorter than the closed bottom holster, the spring will not effectively urge the spray container to a level above the upper rim of the holster which will allow it to be grasped, much less to a level which will allow the spray container to be grasped from the side. The use of a powerful long spring can cause the can to spring beyond the user's grasp and would therefore also be ineffective.

What is needed is a system and method for enabling the retrieval of spray containers in a manner which lends advantage to the user both in terms of time and convenience and which is safe and minimizes the tendency of the spray container to be inadvertently discharged.

SUMMARY OF THE INVENTION

The spray container storage and retrieval system of the present invention encompasses both an apparatus and method enabling quick, safe retrieval of a spray container from a holster.

In a first embodiment, a spray container with a forward trigger is stored in a specially designed sleeve having a special surface for securing the forward trigger from the discharge position. This special surface is formed on a sleeve having a large bottom opening to admit displacement air. The sleeve is fitted with an upper flange to permit the sleeve to be carried in an open-bottomed holster.

The special surface for preventing discharge also orients the spray container to insure that it will always have the same forward orientation. A secure orientation will prevent unwanted discharge, since the user will have an opportunity to develop the quickest removal technique based upon a same location orientation of the discharge head and its forward trigger. The sleeve is adjustable within an open bottomed holster so that fine adjustments in its pointing angle can be made to suit the physical requirements and particularities of the user. A closed bottom holster can be used, especially if there is adequate venting to allow displacement air.

In a second embodiment, a flanged sleeve facilitates the springing displacement of a spray container having a safety flap over the discharge button. This second embodiment is intended to be used with a flap holster, and with a spray container which has no discharge button which can be utilized with a specialized structure on the sleeve.

In a third embodiment, an open holster has a inwardly disposed locking groove which engages a pin collar fitted about the upper portion of a spray container. The canister best utilizable with this holster configuration is, again, one which has no discharge button which can be utilized with a specialized structure on the sleeve. The pin collar can be re-used on subsequent spray containers by removing it from the used spray container and re-installing it on the new spray container.

The third embodiment is released by pushing down and rotating slightly on the upper portion of the spray container to cause its pin collar to unlock from the inwardly disposed locking groove, and to be springingly released upwardly. This technique can also lend itself to rapid deployment of the spray container. Since the release motion is not generally known to others, attempts by others at grasping the spray container will not be successful.

All of the embodiments offer the advantage of fitting within open bottomed holsters of any depth, and within closed bottomed holsters having a depth greater than the spray container sleeve.

BRIEF DESCRIPTION OF THE DRAWINGS

The inventions its configuration, construction, and operation will be best further described in the following detailed description, taken in conjunction with the accompanying drawings in which.

DETAILED DESCRIPTION OF THE PREFERRED EMBODIMENT

Figure 1:
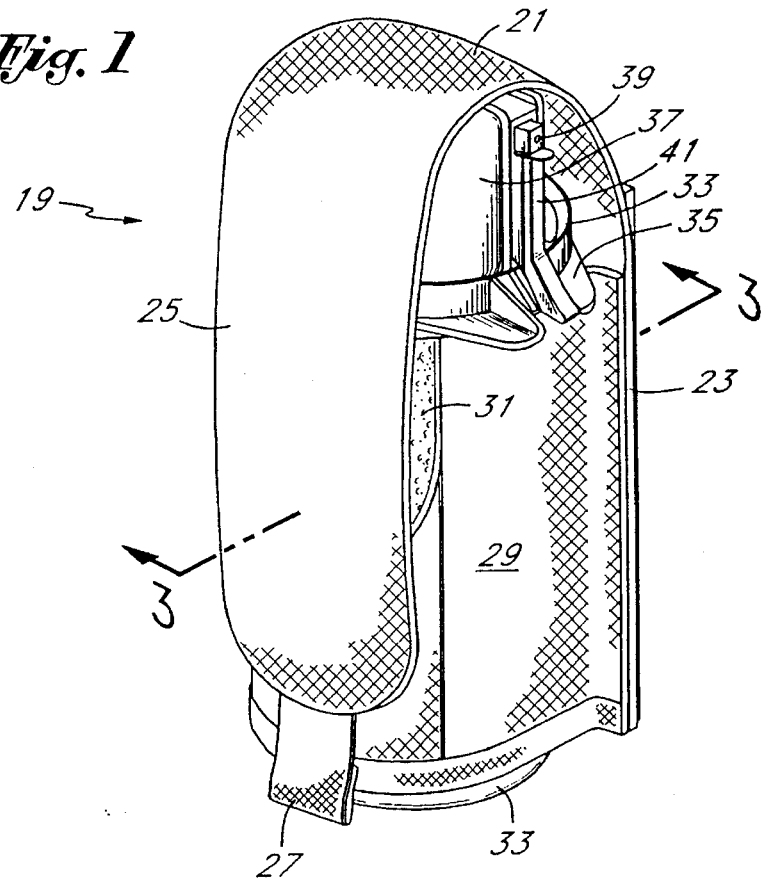
FIG. 1 is a perspective view of a first embodiment of a spray container carriage and deployment system of the present invention for carrying a spray container having a forward trigger.

The description and operation of the invention will be best described with reference to FIG. 1. FIG. 1 illustrates a first embodiment of a spray container carriage and deployment system 19 of the present invention, including a flexible holster type structure having a central length of material 21 having a backing portion 23 which extends into a flap portion 25. Central length of material 21 and backing portion 23 form an annular cylindrical area. From the end of the flap portion 25 extends a quick grasp strap 27 to facilitate raising of the flap portion 25. To the backing portion 23 is sewn a piece of side material 29, which together with the backing portion 23 forms a generally annularly shaped cylinder, and may also be referred to as a holder portion.

The manner of holding the flap portion 25 onto the side material 29 is through the use of hook members and felt members. Typically the hook members will be sewn or otherwise attached to the flap portion 25 while the felt members will be sewn or otherwise attached to the side material 29. In the view of FIG. 1, on the side material 29, a portion of felt member 31 is seen.

Extending slightly above and below the side material 29, a portion of a spray container sleeve 33 can be seen. Spray container sleeve 33 is typically a single molded piece of plastic and has a specialized structure, including an overhanging trigger guard 35 which overhangs the upper portion of the side material 29. Sleeve 33 will also serve to inhibit the puncture of a spray container carried within it, with additional protection coming from the presence of the side material 29. Trigger guard 35 forms one portion of a two portion upper rim flange which will be shown in its entirety in subsequent Figures.

Also shown is a head 37 of a spray container (not yet shown in its entirety) having a spray nozzle 39 and a forward mounted trigger 41. The lower portion of the trigger 41 fits in the middle of the two most forward extending portions of the trigger guard 35. The trigger guard 35 is shaped to urge trigger 41 away from the head 37 while the head 37 of the spray container is urged downwardly with respect to the sleeve 33. The trigger guard 35 serves to both guard against force coming from a direction at the forward most extent of the sleeve 33, as well as force applied to the upper portion of the trigger 41.

Since the head 37 is oblong, the action of the flap portion 25 in coming over the narrower portion of the head 37 is to prevent the head 37 from being turned. The trigger guard 35 also serves to prevent the head 37 from being turned with respect to the sleeve 33. The sleeve 33 may have a close fit within the flexible holster type structure including backing portion 23 and side material 29. Alternatively, sleeve 33 may be cemented or otherwise fixed within the annular space created by the backing portion 23 and side material 29.

Figure 2:
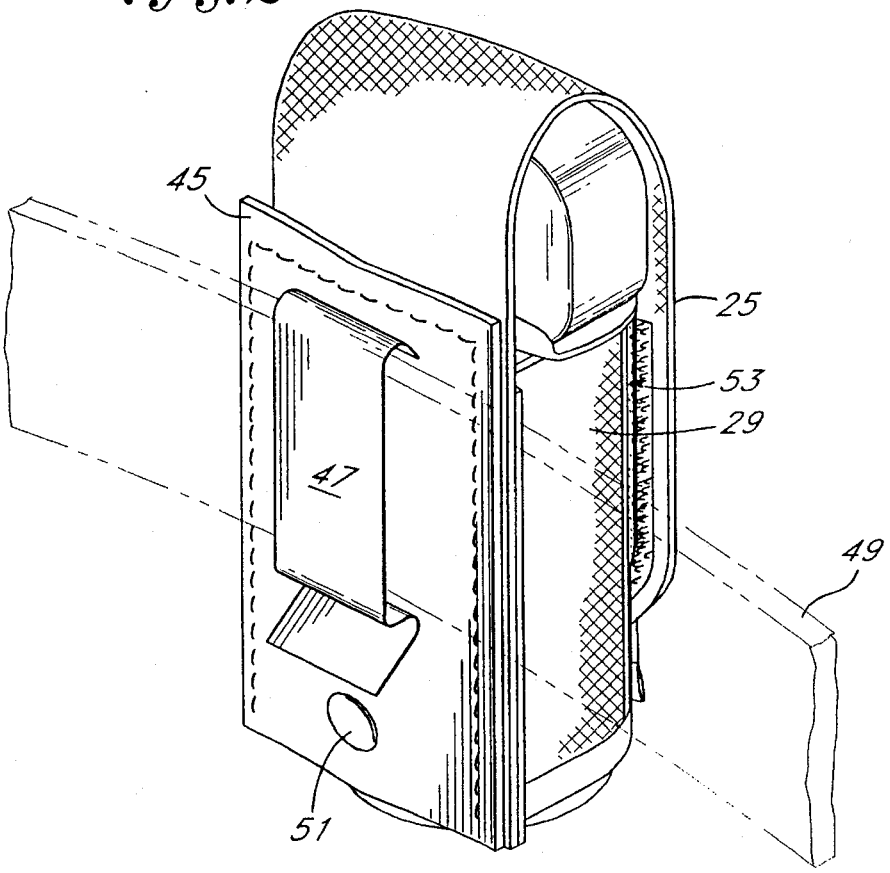
FIG. 2 is a perspective view of the spray container carriage and deployment system of the present invention as shown in FIG. 1, but as seen from the opposite angle and as shown with respect to a belt, shown in phantom, upon which it may be clipped for convenient carriage.

Referring to FIG. 2, a view from the opposite perspective shown in FIG. 1 illustrates one possible configuration of the rear side of the spray container carriage and deployment system 19. A piece of backing material 45 is directly attached to the backing portion 23 and is used to support a belt clip 47. A belt 49, shown in phantom, extends through the belt clip 47. It is understood that a belt loop, or a closed belt loop could have been employed in place of belt clip 47.

A portion of the belt clip 47 may extend between the backing material 45 and the backing portion 23, and it may be secured to both the backing material 45 and the backing portion 23 with a rivet 51. The viewing perspective of FIG. 2 affords a view of a portion of the hook material 53 sewn to flap portion 25. The felt member 31 to which the hook material 51 is attached is not as readily seen.

FIGS. 1 and 2 illustrate the continuous nature of the central length of material 21, including its backing portion 23 and flap portion 25. It is understood that the backing portion 23 and flap portion 25 may be made of separate lengths of material.

Figure 3:
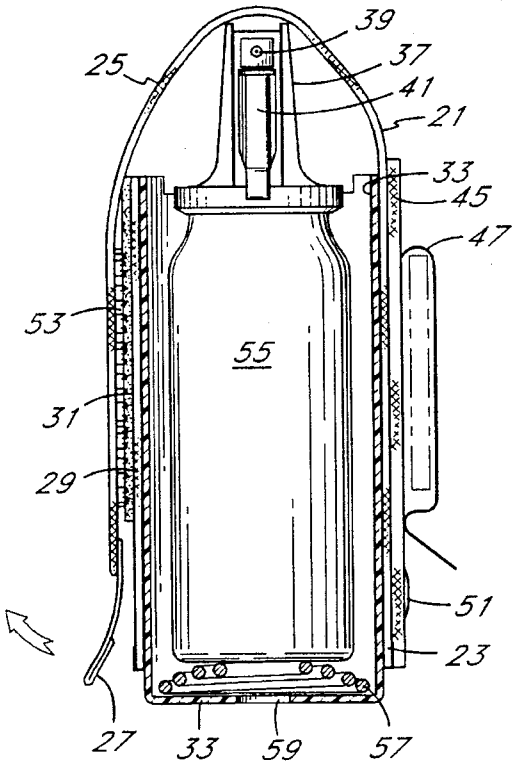
FIG. 3 is across section of the spray container carriage and deployment system of the present invention taken along line 3—3 of FIG. 1.

Referring to FIG. 3, a partial sectional view taken along line 3—3 of FIG. 1 illustrates a sectional view of all structures with the exception of what is now shown as a spray canister 55. Spray canister 55 supports the head 37 and head 37 is generally rigidly affixed to the spray canister 55. The combination of spray canister 55 and head 37 with its structures may be referred to as a spray container.

With the currently shown partial section, the trigger guard 35 is not visible. More of the structure with which the trigger guard 35 was integral is shown in section, namely sleeve 33. As can be seen, spray canister 55 fits within sleeve 33. At the bottom inside of sleeve 33 is a spring 57 which springingly bears upwardly against the spray canister 55 with respect to the lower extent of the sleeve 33.

As can be seen, the lower extent of sleeve 33 has an aperture 59. Typically spring 57 will have a wide base which will engage the lower extent of sleeve 33 some distance from the aperture 59. The upper portion of the spring 57 may have a narrower upper extent since it urges the bottom of the spray canister 55 which is flat. The use of a spring 57 which has its coils horizontally cascade over its vertical extent conserves space and provides for spring force over a greater extent of the spring 57 compression range. Taken differently, under full compression, the coils of spring 57 will tend to rest inside adjacent coils and maintain some springing urged force when compressed to a height less than the height of the product of the number of coils times each coil's vertical thickness.

Figure 4:
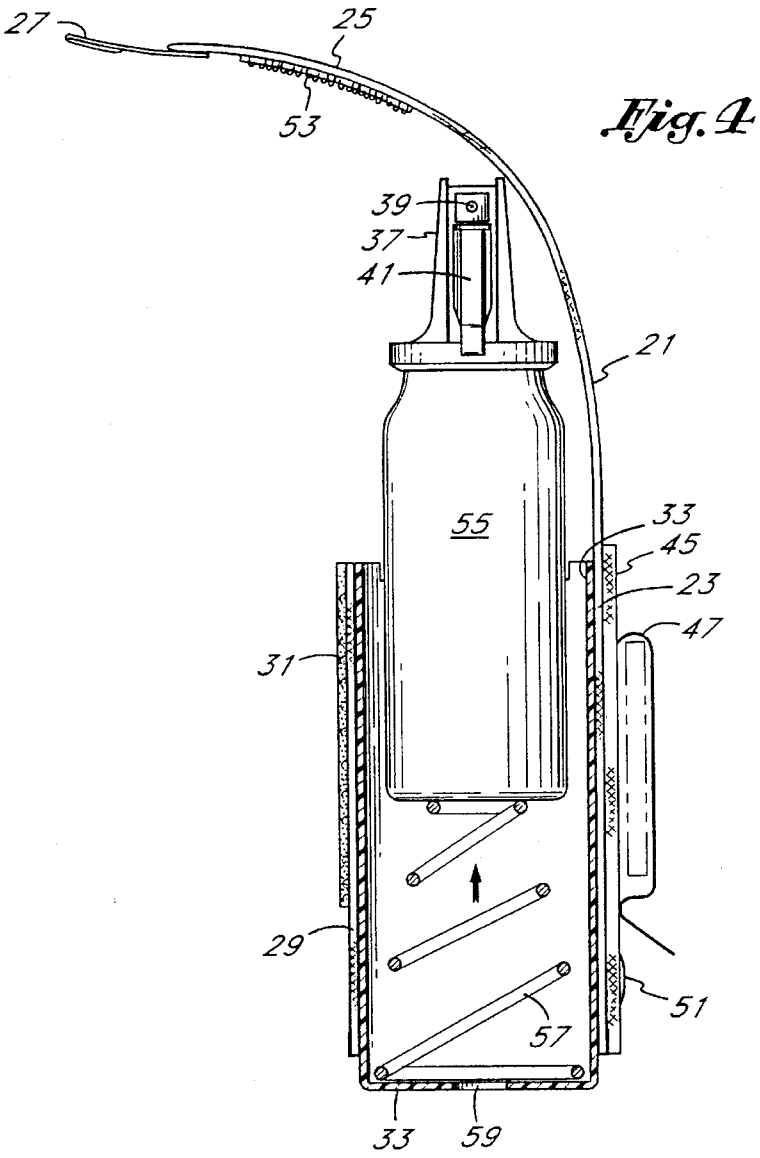
FIG. 4 is a view taken from the perspective as shown in FIG. 3, but showing, the flap of the carrier in an open position and showing the spray container in an upwardly displaced position being urged upwardly with a spring.

Referring to FIG. 4, a view is shown where the flap portion 25 has been lifted, causing the hook material 53 to separate from the felt material 31. As soon as the flap portion is raised, the spring 57 urges spray canister 55 upwardly with respect to sleeve 33. FIG. 4 illustrates the approximate extent to which the spray canister 55 will be raised. Too long a spring 57 will cause the spray canister 55 to perhaps be lifted beyond the extent of the sleeve 33. Alternatively, the spring 57 can be stretched slightly to adjust the height to which the canister 55 will be lifted.

Note that in the position of FIG. 4, that the upper portion of the spray canister 55 and head 37 are available for manual grasping from the rear direction. Thus, for a right handed position, the right hand may approach the canister 55 and head 37 from the rear with the index finger readied on the trigger 41, and the other fingers firmly grasping the canister 55 as it is brought the remainder of the way out of the sleeve 33.

In addition, the right hand can be used to insert the fingers in between the flap portion 25 and the side material 29, causing the spray canister 55 to spring upwardly into the forward facing palm of the hand and then to be brought out in a grasped orientation as above. This "quick draw" technique can be quite advantageous for situations where the pepper spray is needed quickly.

As was noticed in FIG. 1, the sleeve 33 has a specialized trigger guard 35 overlying the side material 29. The user can turn the sleeve 33 within the side material 29 to cause the deployment system 19 to accommodate a left-handed user. As previously stated, the sleeve 33 can be cemented to the side material 29 to achieve a permanent left or right handed orientation.

Figure 5:
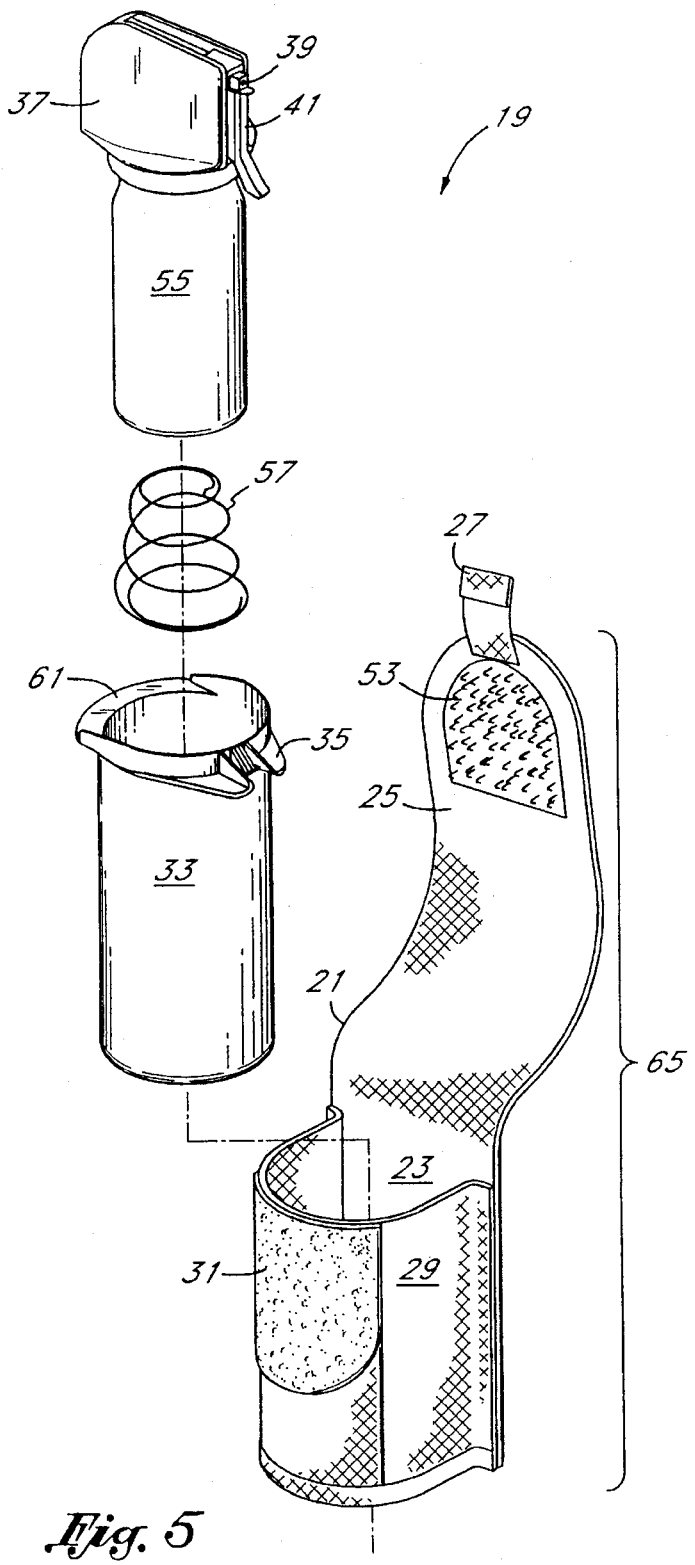
FIG. 5 is an exploded view of the spray container carriage and deployment system of the present invention as was shown in FIGS. 1–4.

Referring to FIG. 5, an exploded view is shown. The trigger guard 35 on the sleeve 33 is seen as overhanging the cylindrical portion of the sleeve 33, and a rear flange portion 61 can be seen at the side of the sleeve 33 opposite the trigger guard 35. Both the trigger guard 35 and flange portion 61 serve to limit the vertically downward extent to which sleeve 33 can be inserted into the side material 29.

Given the parameters of the forgoing configuration, the combination of the central length of material 21, backing portion 23, flap portion 25, and side material 29, which is shown collectively in FIG. 5 as a holster 65, may vary widely. For example, if the side material 29 is vertically longer than the sleeve 33, the sleeve 33 will not go down into the area between the side material 29 and backing portion 23, and the deployment system 19 will work properly. If the side material 29 is vertically shorter than the sleeve 33, the sleeve 33 will extend down beyond the bottom extent of side material 29 and backing portion 23, and the deployment system 19 will still work properly.

Further, once a sleeve 33 is matched to a spray canister 55, the same holster 65 can be used for a variety of lengths of spray canister 55/sleeve 33 pairs. Again, it is recommended to keep the area between the side material 29 and backing portion 23, of a diameter which will frictionally fit the sleeve 33. In this manner, the sleeve 33 will tend to keep any orientation into which it is forced, and holster 65 can then be used with different lengths of sleeve 33 interchangeably.

Figure 6:
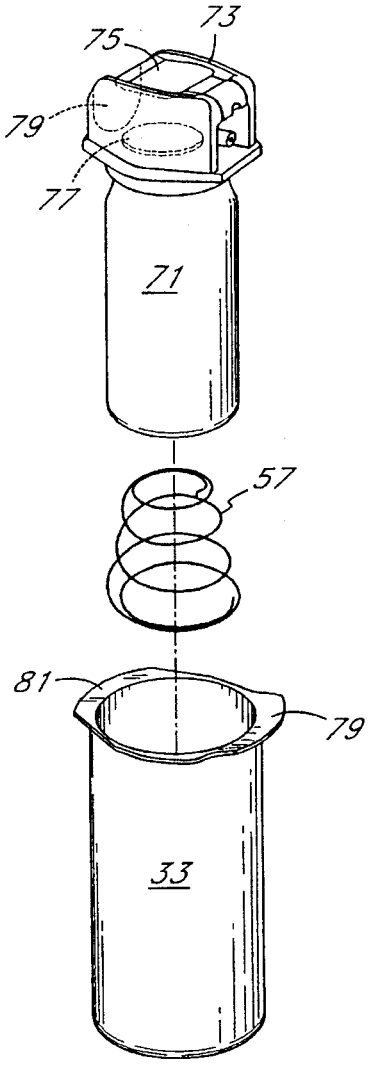
FIG. 6 is an exploded view of a second embodiment of the carriage and deployment system of the present invention utilizable in conjunction with a spray container which may have no discharge button which can be utilized with a specialized structure on the sleeve, and which may have a safety cover.

Referring to FIG. 6, a second embodiment of the deployment system of the present invention is illustrated. A spray canister 71 has a head 73 which includes a safety flap 75 overlying the actuation button 77. A rear entry 79 facilitates the insertion of the finger, along with the swinging away of safety flap 75 to give access to the actuation button 77. The spring 57 is generally similar to the one shown for FIGS. 3–5. The sleeve 33 does not need the trigger guard 35 shown in the previous Figures. This is due to the fact that the head 73 does not have a trigger which can be guarded with a sleeve 33. The combination of spray canister 71 and head 73 with its structures may also be preferred to as a spray container.

Instead, the sleeve 33 has a pair of opposed flanges, including a first flange portion 79 and a second flange portion 81. First flange portion 79 is swept upwardly and slightly higher than second flange portion 81 in order to radially "lock" the spray canister 71 and head 73 into place with respect to the sleeve 33, and prevent its being turned to a position, usually other than the forward position. In this configuration, the spray canister 55 and head 73 will have a forward orientation similar to the orientation shown for FIGS. 1–5. Again, a forced turning of the sleeve 33 can alter this position to any position with which the user is most comfortable.

It is understood that the first flange portion 79 can be made identical to the second flange portion 81. In this event, the spray canister 55 and head 73 will be able to turn freely to any position within the sleeve 33. The opposed flange portions 79 and 81 enable the elimination of flanged extension on the side of the sleeve 33 to enable the sleeve 33 to fit within the holster 65 without protruding in the direction of the backing portion 23 nor in the direction which would bear against the flap portion 25 when flap portion 25 is closed over the side material 29. The same quick draw technique described for the first embodiment holds true for the second embodiment.

Figure 7:
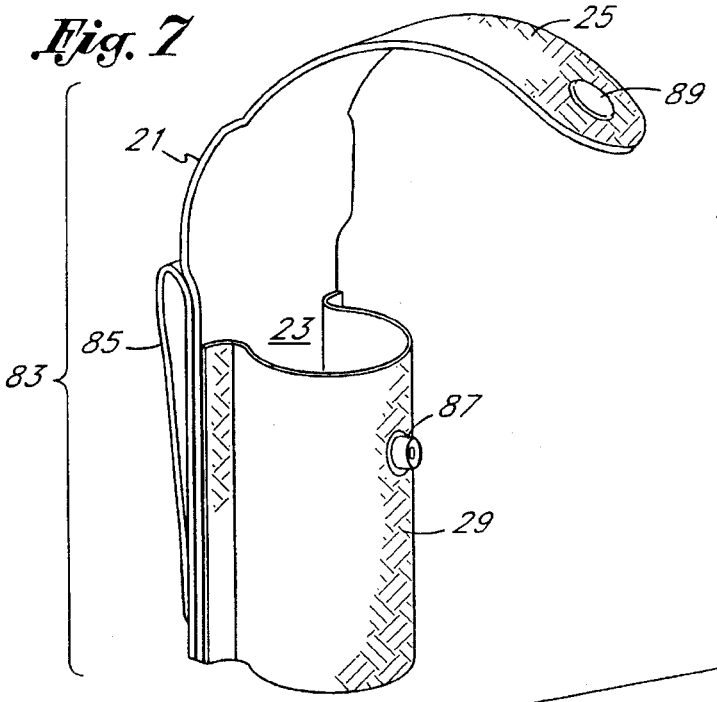
FIG. 7 illustrates, as an alternative holster configuration utilizable with all embodiments herein, a snap flap holster which may be used in lieu of the hook and loop fastener which was shown in conjunction with the embodiments shown in FIGS. 1–6.

In the first and second embodiments of FIGS. 1–6, the holster 65, including the central length of material 21, backing portion 23, flap portion 25, and side material 29, illustrated was shown as being made from a woven material. FIG. 7 illustrates an embodiment which is made of hard plastic, or more likely, leather. The same structures of what is illustrated as a holster 83, including central length of material 21, backing portion 23, flap portion 25, and side material 29, are present and made of, for example, leather. Backing portion 23 has attached a belt loop 85, typically made of the same material as the remainder of holster 83.

However, instead of hook members 53 and felt members 31, a male snap member 87 supported by side material 29 is matable with a female snap member 89 supported by flap portion 25. The snap members 87 and 89 may enable a much quicker deployment of the canisters 55 or 71 shown in the previous Figures, and will provide a more precision closing of the holster 83. A more precise closing will prevent a user from inadvertently closing the flap portion 25 too tightly.

Figure 8:
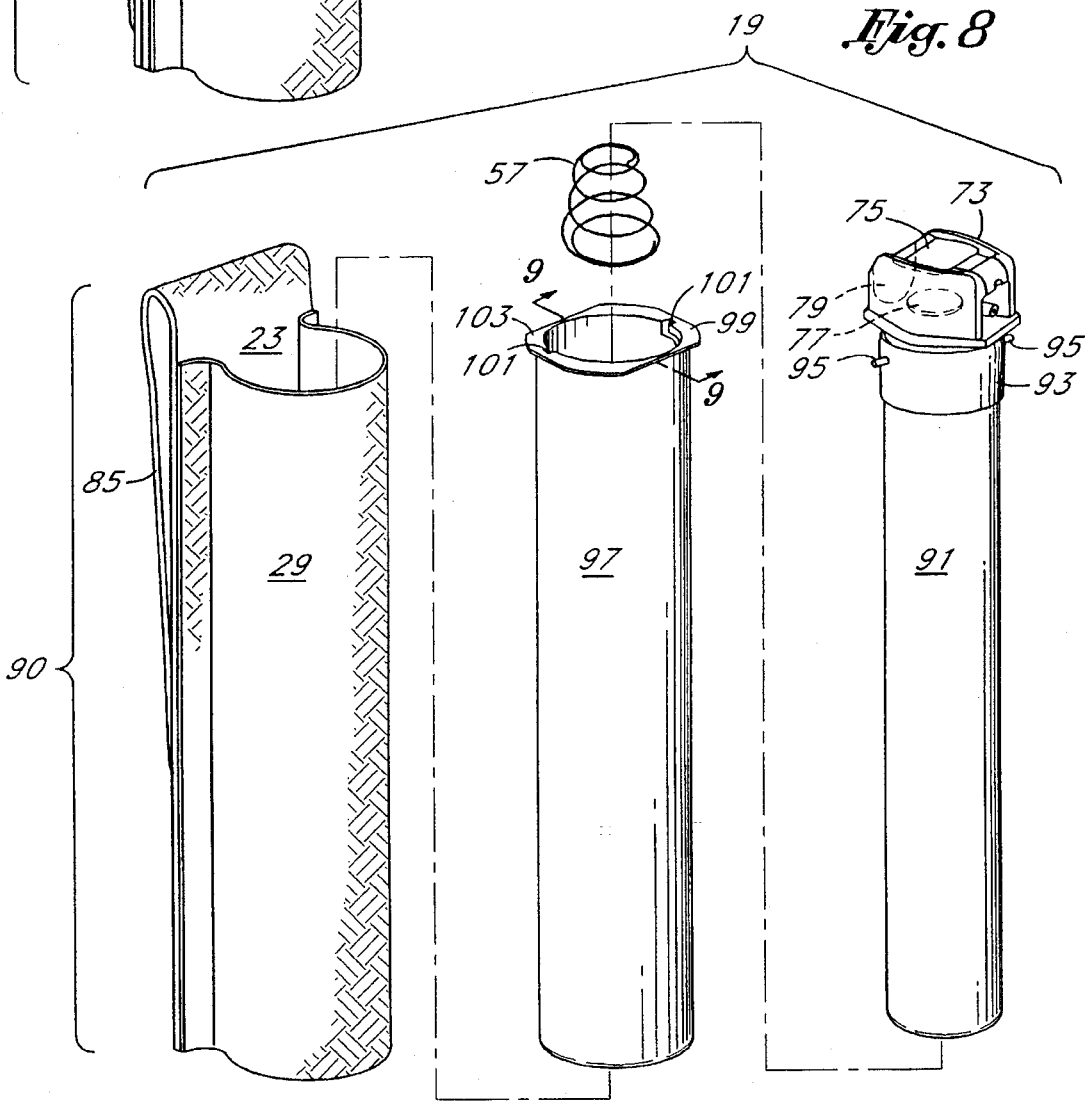
FIG. 8 is an exploded view of a third embodiment of the carriage and deployment system of the present invention generally without a holster-type flap, and employing a pin collar engaging an inwardly disposed locking groove within the spray container sleeve.

Referring to FIG. 8, a third embodiment of the deployment system 19 is shown with a holster 90 similar to the holster 65 shown in FIG. 7. A holster 65 could be illustrated just as easily for this embodiment as for the earlier two embodiments, and holster 65 could be illustrated just as easily for the earlier two embodiments as for this embodiment. Note however that holster 90 has no flap portion 25, and that the backing portion 23 above the side material 29 is folded behind the backing portion 23 to form the belt loop 85. Thus, holster 90 is an open, or non-flap configuration.

An elongate canister 91 supports the head 73 which was shown with reference to FIG. 6. Head 73 includes safety flap 75 overlying the actuation button 77, and rear entry 79 as was shown with respect to FIG. 6. Again, the combination of spray canister 91 and head 73 with its structures may also be referred to as a spray container. However, a pin collar 93, having at least one circumferentially outwardly disposed pin 95 is fitted around the spray canister 95, although a pair of pins 95 are shown. The pin collar 93 should have a snug fit with respect to spray canister 91, and should be located high with respect to canister 91 and near head 73.

Near the center of the exploded view of FIG. 8, an elongated sleeve 97 is illustrated. The upper rim of sleeve 97 has a flange 99 which encircles the upper open end of sleeve 97. As can be seen, there are two slots 101. The rearwardly located slot 101 can be seen as extending vertically downward for a short distance and then horizontally for a short distance.

Figure 9:
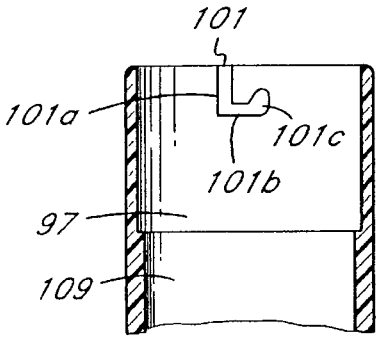
FIG. 9 is an expanded view of the slot shown in FIG. 8 and illustrating the details thereof.

Referring to FIG. 9, a sectional view of the sleeve 97 taken along line 9—9 of FIG. 8 is shown. The angle with which section 9—9 cuts the sleeve 97 exposes the slot 101 with a view toward centering it with respect to FIG. 9. Slot 101 has a generally vertical portion 101*a*, a generally horizontal portion 10l*b*, and a generally vertical portion 101*c* ending at a terminus. Portion 101*c* is drawn at a 5° angle with respect to portion 10l*b* to illustrate that it need not be made completely vertical.

The canister 91 is inserted in the sleeve 97, and against the spring 57. Once the pin 95 of the pin collar 93 reaches the flange 99, the pin 95 must be accommodated by one of the slots 101, for the canister 91 to be further urged downward. Once the pin 95 is accommodated by the slot 101, it travels down portion 101*a*. Once it reaches portion 10l*b*, the head 73, canister 91, pin collar 93 and pin 95, moving as one unit, may be rotated to cause pin 95 to travel along portion 101*b* and toward portion 101*c*. Once portion 101*c* is reached, the upwardly urging force from the spring 57 will cause pin 95 to travel to the end of portion 101*c*, and remain there until and unless manually activated.

The flange 99 will allow sleeve 97 to fit within the area between backing portion 23 and side material 29 only as far as the flange 99. Thus, a holster 90 longer than sleeve 97 would work well with sleeve 97, and a sleeve 97 longer than holster 90 would still work well. It is understood that pin collar 93 could be equipped with a pair of pins 95 or a single pin 95.

Further, alterations to the slot 101 can be had to either improve the ease with which the canister 91 can be removed, or increase the effort required to remove canister 91. For example, if portions 101*a* and 101*c* were strictly vertical and portion 10*b* were horizontal, the canister 91 would have to be moved more precisely to effect removal. However, if portions 101*a* and 10l*b* were combined into a gradually sloping portion, and if portion 101*c* were gently sloping upwardly, the canister 91 could be ejected with more twisting force and less attention paid to pushing the head 73 down, and rotation to a point of upward release.

Figure 10:
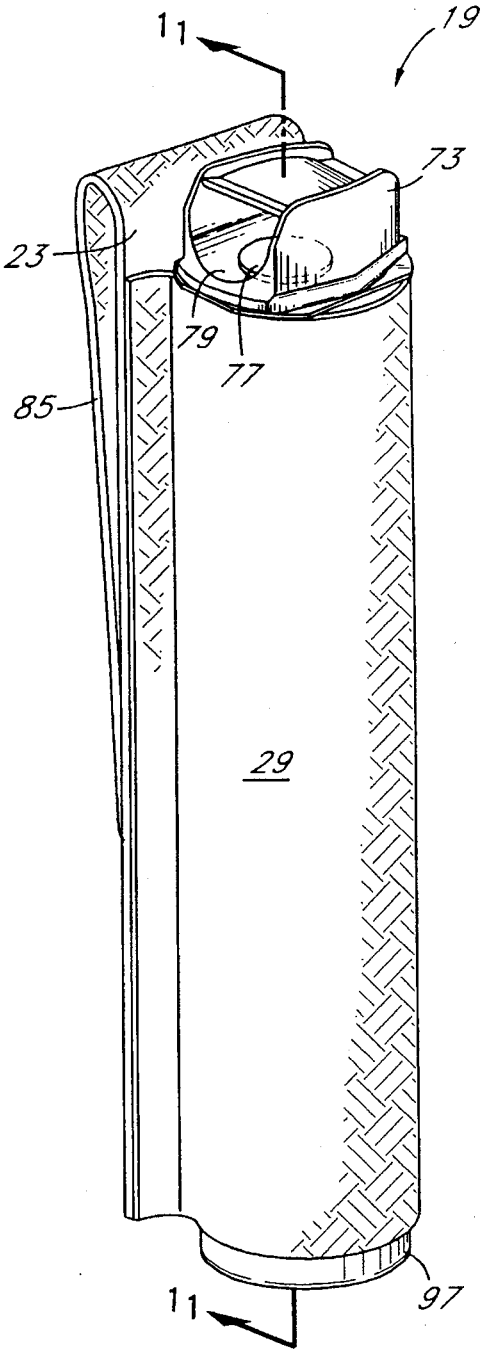
FIG. 10 is a perspective view of the third embodiment of the carriage and deployment system of the present invention as was shown in FIGS. 8 and 9.

Referring to FIG. 10, a perspective view of the third embodiment of the spray container carriage and deployment system of the present invention illustrates the assembled version of the components shown in FIG. 8. As can be seen, the squaring of the edges of the flange 99 eliminates overhang with respect to the side material 29, and eliminates projection toward the backing portion 23.

Figure 11:
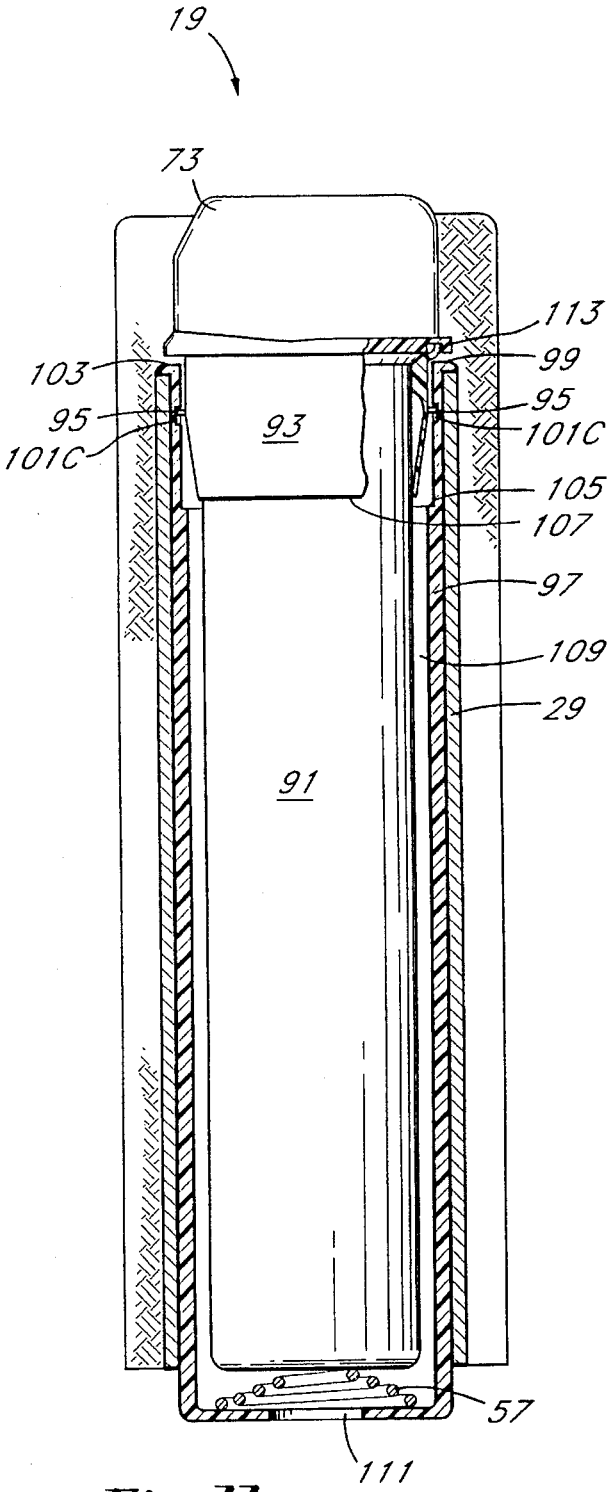
FIG. 11 is a cross sectional detail taken along section 11—11 of FIG. 10 and illustrating a cross sectional view of the pin collar, the manner in which it embraces the canister and an upward projection which prevents rotation of the spray canister's head with respect to the pin collar.

Referring to FIG. 11, a sectional view of the outer portions of the deployment system 19 of the third embodiment illustrates a groove 105 which acts as a downward stop for the pin collar 93. The groove 105 prevents undue downward pressure being exerted on the pin 95. In the rest position, there is some space between the bottom edge 107 of the pin collar 93 and the groove 105, since the spring 57 has been allowed to urge the canister 91 upwardly to place the pin 95 in its resting position 101*c*.

As can be seen, adequate space 109 exists between the canister 91 and the inside of the sleeve 97. In this configuration, with the relatively closer fit between the pin collar 93 and the inside of the sleeve 97, the spray container will be securely carried without rattling. An aperture 59 also serves to introduce displacement air into the sleeve 97 when the spray container, including canister 91 and head 73 are being deployed.

As is also shown in FIG. 11, one edge 113 of pin collar 93 extends upwardly to engage an upwardly swept forward under surface of the head 73. Although the pin collar 93 generally tightly engages the canister 91, there may be many spray container designs where the head 73 is allowed to rotate with respect to the canister 91. In such a case, an attempt at deployment of the spray container might result in turning only of the head 73, leaving the pin collar 93 and canister 91 un-rotated.

The edge 113 is generally straight and matches the upwardly swept surface of the head 73. Differently shaped heads can employ other, differently shaped matching surfaces of the edge 113. Generally, the pin collar 93 may be as shown in FIG. 12, hugging the upper shoulder of the canister 91 to more closely conform to the canister 91. The upper edge of the pin collar 93 can be made to conform to any lower features of the head 73 in order to rotationally fix the canister 91 and the head 73 together.

It is further understood that variations in all of the embodiments of the spray container carriage and deployment system of the present invention are contemplated, including the provision of any of the sleeves 33 and 97 without the spring 57. Such uses are contemplated because of the advantage that such sleeves 33 and 97 give in protecting the canisters 91, 71, and 55. In instances where the spray container is carried without such a sleeve for protection, hardware such as snap members 87 and 89 or belt clip 47 can wear upon the canisters 91, 71, and 55 causing the spray containers to rupture while still holstered in their carrying cases. If this occurs while an officer is pursuing a suspect on foot, or in some other risky circumstance, the rupture could immobilize the officer, and cause greater disaster than the pepper spray or mace alone.

While the present invention has been described in terms of a spray container carriage and deployment system, one skilled in the art will realize that the structure and techniques of the present invention can be applied to many appliances. The present invention may be applied in any situation where rapid deployment of a carried object is needed.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A spray container storage and retrieval system comprising:

an annular cylindrical sleeve having an upper open end including at least a section of flange extending laterally outward from said upper open end, a mid section and a lower partially closed end, said sleeve defining an inwardly disposed slot having a first portion which extends from the upper open end of said sleeve in a downwardly direction and a second portion which extends to a generally upward direction to a terminus;

a spring having a first end abutting the inside of said sleeve at said partially closed end, and a second end;

a holster having a holder portion with an upper opening of a size sufficient to receive said partially closed end of said sleeve and at least a portion of said mid section of said sleeve;

an annular pin collar adapted to be secured to the spray container and co-axially fittable within and co-axially rotatable with respect to said annular cylindrical sleeve; and a pin supported by and radially outwardly extending from said pin collar and engageable with said inwardly disposed slot of said sleeve.

2. The spray container storage and retrieval system recited in claim 1 wherein said at least a section of flange is continuous about the upper portion of said sleeve.

3. The spray container storage and retrieval system recited in claim 1 wherein said holster further comprises:

a central length of material having a backing portion and a belt loop portion; and an annular cylindrical portion attached to said backing portion and defining, with said backing portion, said holder portion.

4. The spray container storage and retrieval system recited in claim 1 wherein said holder portion of said holster has a bottom opening.

5. The spray container storage and retrieval system recited in claim 1 and further comprising a spray container surrounded by said pin collar, said spray container when within said sleeve compresses said spring and is secured by said pin of said pin collar in said second portion of said slot.

6. The spray container storage and retrieval system and spray container recited in claim 5 wherein said spray container further comprises:

a spray canister; and a head mounted on said spray canister having a safety flap overlying an actuation button.

7. The spray container storage and retrieval system and spray container recited in claim 6 wherein said pin collar includes a projection abutting said head to prevent said head from being turned relative to said pin collar.

* * * * *